US010205293B2

(12) United States Patent
Zheng et al.

(10) Patent No.: US 10,205,293 B2
(45) Date of Patent: Feb. 12, 2019

(54) COMMUTATOR, MOTOR USING SAME AND METHOD OF MANUFACTURING THE COMMUTATOR

(71) Applicant: Johnson Electric S.A., Murten (CH)

(72) Inventors: Jing Chao Zheng, Hong Kong (CN); Chi Man Law, Hong Kong (CN); Xiu Xian Wang, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 134 days.

(21) Appl. No.: 15/460,881

(22) Filed: Mar. 16, 2017

(65) Prior Publication Data

US 2017/0271832 A1 Sep. 21, 2017

(30) Foreign Application Priority Data

Mar. 17, 2016 (CN) ..... 2016 1 0159052

(51) Int. Cl.

| | |
|---|---|
| ***H01R 39/06*** | (2006.01) |
| ***H01R 39/04*** | (2006.01) |
| ***H01R 39/02*** | (2006.01) |
| ***H01R 43/06*** | (2006.01) |

(52) U.S. Cl.

CPC ..... *H01R 39/025* (2013.01); *H01R 39/045* (2013.01); *H01R 43/06* (2013.01)

(58) Field of Classification Search

CPC ..... H01R 39/00; H01R 39/02; H01R 39/025; H01R 39/04; H01R 39/045; H01R 39/06; H01R 39/20; H01R 39/32; H01R 43/00; H01R 43/06; B32B 37/06

See application file for complete search history.

(56) References Cited

U.S. PATENT DOCUMENTS 6,222,298 B1 * 4/2001 Saito ..... H01R 39/045 310/233
6,674,212 B2 * 1/2004 Inukai ..... H01R 39/06 310/219

(Continued)

FOREIGN PATENT DOCUMENTS

DE 10 2008 004 0378 * 1/2006 ..... H01R 43/06

*Primary Examiner* — Tran Nguyen

(74) *Attorney, Agent, or Firm* — Muncy, Geissler, Olds & Lowe, P.C.

(57) ABSTRACT

The invention relates to a commutator, comprising an insulating base and a plurality of commutator segments arranged on the insulating base, wherein each commutator segment comprises a metal layer, a transition layer and a graphite layer arranged on the base in sequence. The transition layer contains a material identical to that of the graphite layer and a material identical to that of the metal layer. The invention further relates to a motor comprising the commutator and a method for manufacturing the commutator. As the transition layer contains the material identical to that of the graphite layer and the metal layer, the problem that the graphite layer and the metal layer are cracked during high temperature sintering is resolved. The service life of the commutator is prolonged. The method for manufacturing the commutator reduces chemical contamination and production cost caused by electroplating and brazing used in a traditional technology.

18 Claims, 7 Drawing Sheets

(56) References Cited

U.S. PATENT DOCUMENTS

| | | | | |
|---|---|---|---|---|
| 6,833,650 | B2 * | 12/2004 | Hara | H01R 39/025<br>310/233 |
| 7,019,432 | B1 * | 3/2006 | Potočnik | H01R 39/06<br>29/597 |
| 2002/0167238 | A1 * | 11/2002 | Kogure | H02K 5/148<br>310/89 |
| 2012/0194029 | A1 * | 8/2012 | Nishio | H01R 39/045<br>310/237 |

* cited by examiner

COMMUTATOR, MOTOR USING SAME AND METHOD OF MANUFACTURING THE COMMUTATOR

CROSS REFERENCE TO RELATED APPLICATIONS

This non-provisional patent application claims priority under 35 U.S.C. § 119(a) from Patent Application No. 201610159052.2 filed in The People's Republic of China on Mar. 17, 2016.

FIELD OF THE INVENTION

The present invention relates to a commutator, a motor using the same and a method of manufacturing the commutator.

BACKGROUND OF THE INVENTION

A graphite commutator is one of the most important parts of an oil pump motor. The quality of a graphite commutator is important to the performance of a motor.

An existing graphite commutator is mainly composed of graphite (charcoal) sheets and copper sheets. The graphite sheets are used to conduct electricity and as wear parts. The copper sheets are used for electric conduction and are connected with motor windings. The connection and assembly of the graphite sheets and the copper sheets is one of key points of the graphite commutator manufacturing process. One of the existing manufacturing processes is to firstly metallize the surface of the graphite sheet by an electroplating method and then welding the copper sheet together by means of a solder-fill process. The manufacturing processes has the disadvantages of high cost of electroplating process, environmentally-unfriendly and easiness to fall off the graphite sheet. A second existing manufacturing process is to press the graphite powder and pure metal powder (mainly copper powder) through direct powder pressing process and then forming the surface metallized graphite sheet through low temperature curing thermal treatment process. The copper sheets are also connected by welding. The design has the disadvantages that the resistance of the product is high and the efficiency of the motor is low as the high temperature thermal treatment (such as sintering temperature above 500 degrees) cannot be used. If the product is subject to high temperature thermal treatment, due to the difference in the thermal expansion coefficient of the graphite material and the metal material, the junction of the graphite layer and the metal layer is very easy to crack. A third existing manufacturing process is to direct weld the graphite sheet and the copper sheet by a high-temperature soldering method. This process has the disadvantage of high cost, and causing the softening of the copper sheet which increases the difficulty to the motor assembly.

SUMMARY OF THE INVENTION

In view of this, it is necessary to provide a commutator, a motor using the same and a method of manufacturing the commutator.

A first aspect of this invention is to provide a commutator, comprising an insulating base and a plurality of commutator segments arranged on the insulating base, wherein each commutator segment comprises a metal layer, a transition layer and a graphite layer all arranged on the insulating base in sequence, the transition layer containing a material identical to that of the graphite layer and a material identical to that of the metal layer.

Preferably, the commutator further comprises a plurality of conductive terminals, each of the conductive terminals being correspondingly connected to the metal layer of the corresponding commutator segment.

Preferably, the material of the graphite layer is graphite powder, and the graphite powder is at least one selected from a group consisting of natural graphite, artificial graphite and meso-carbon microbeads.

Preferably, the material of the transition layer is at least one selected from a group consisting of graphite powder and metal powder.

Preferably, the mass ratio of the graphite powder in the transition layer is 10% to 30%, and the mass ratio of the metal powder is 70% to 90%.

Preferably, the graphite powder is at least one selected from a group consisting of natural graphite, artificial graphite, coke and meso-carbon microbeads, and the metal powder is at least one selected from a group consisting of Al, Cu, Ag, Ni, Bi, Sb.

Preferably, the material of the metal layer is metal powder, and the metal powder is at least one selected from a group consisting of Al, Cu, Ag, Ni, Bi, Sb.

Preferably, the transition layer thickness is 100-500 μm, the metal layer thickness being 100-500 μm, the graphite layer thickness being 1600-2400 μm.

A second aspect of this invention is to provide a motor, comprising a housing, and a rotor and electric brushes installed in the housing, further comprising the commutator according to the first aspect of this invention for being in sliding contact with the electric brushes.

A third aspect of this invention is to provide a method of manufacturing a commutator, comprising the following steps of:

forming a metal layer, a graphite layer and a transition layer which is sandwiched between the metal layer and the graphite layer, wherein the transition layer containing a material identical to that of the graphite layer and a material identical to that of the metal layer;

forming a green body by pressing the graphite layer, the transition layer and the metal layer; and sintering the green body.

Preferably, wherein the metal layer is formed by filling metal powder in a die and then press the metal powder, the graphite layer being formed by filling graphite powder in a die and then press the graphite powder, the transition layer being form by filling metal powder and graphite powder in a die and then pressing the metal powder and graphite powder.

Preferably, the graphite layer is formed in advance and then the transition layer is formed on the graphite layer.

Preferably, the transition layer is formed in advance and then the metal layer is formed on the transition layer.

Preferably, the metal layer is formed in advance and then the transition layer is formed on the metal layer.

Preferably, the transition layer is formed in advance and then the graphite layer is formed on the transition layer.

Preferably, graphite powder of the graphite layer is at least one selected from a group consisting of natural graphite, artificial graphite and meso-carbon microbeads.

Preferably, a mass ratio of the graphite powder in the transition layer is 10% to 30%, and a mass ratio of the metal powder is 70% to 90%.

Preferably, the graphite powder is at least one selected from a group consisting of natural graphite, artificial graphite, coke and meso-carbon microbeads, and the metal powder is at least one selected from a group consisting of Al, Cu, Ag, Ni, Bi, Sb.

Preferably, a thickness range of the transition layer is 100-500 μm, a thickness range of the metal layer is 100-500 μm, and a thickness range of the graphite layer is 1600-2400 μm.

Compared with the prior art, the present invention solves the problem of high resistance and low motor efficiency in the existing design by adding an intermediate transition layer and solves the problem of cracking between the metal layer and the graphite layer under a condition of high temperature sintering. The service life of the commutator is prolonged and the performance of the motor is improved. The method of manufacturing a commutator provided by the present invention reduces the chemical contamination and the production cost caused by the electroplating and brazing used in the traditional technology. The binding between the graphite and a metal surface is improved by die pressing and sintering technology.

The present invention is further illustrated by the following specific detailed description of various embodiments with reference to the above drawings.

DETAILED DESCRIPTION OF VARIOUS EMBODIMENTS

The technical solution and the other advantageous effects of the present invention will be obvious through detailed description of various embodiments of the present invention with reference to the drawings.

Figure 1:
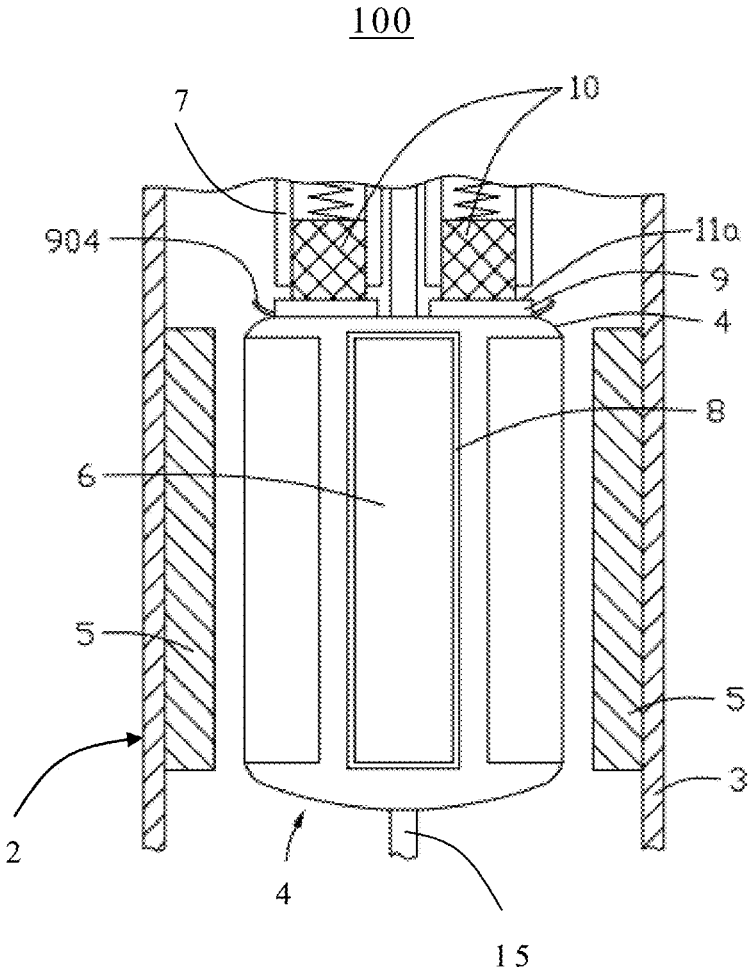
FIG. 1 is a schematic diagram of a cross section of a motor provided by one embodiment of the present invention.

FIG. 1 is a schematic diagram of a cross section of a motor 100 according an embodiment of the present invention. Please referring to FIG. 1, the motor 100 comprises a stator 2 and a rotor 4 rotatably mounted to the stator 2. The stator 2 comprises a housing 3, permanent magnets 5 mounted onto inner wall of the housing 3, a brush holder 7 directly or indirectly mounted to the housing 3, and electric brushes 10 slidably mounted to the brush holder 7. The rotor 4 comprises a shaft 15, a rotor core 6 fixed onto the shaft 15, a commutator 9 fixed onto the shaft 15 and adjacent to the rotor core 6, and rotor windings 8 wound onto the rotor core 6. The rotor core 6 forms a plurality of winding slots for receiving the windings 8. The electric brushes 10 are for in sliding contact with the commutator 9 so as to commutating current of the rotor windings 8. The commutator 9 comprises a contact surface 11*a* for in sliding contact with the brushes 11*a*.

Figure 2:
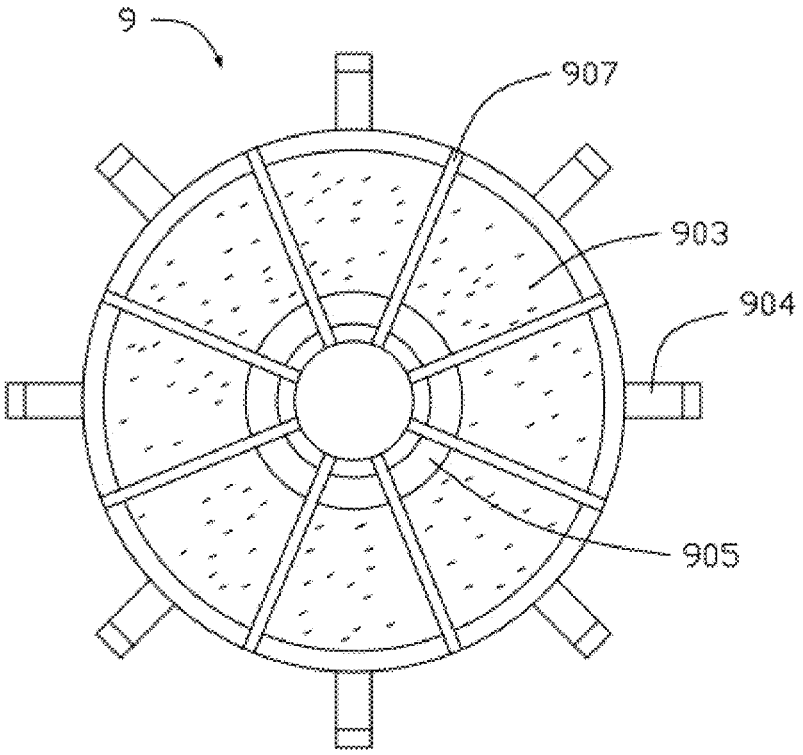
FIG. 2 is a schematic plan view of the commutator used in the motor of FIG. 1.

Please referring to FIG. 2 together, the commutator 9 is preferably a flat type graphite commutator, comprising an insulating base 905, a plurality of commutator segments 903 and conductive terminals 904. The commutator segments 903 are circumferentially distributed on the insulating base 905 and mutually spaced at an interval, and are used for being in sliding contact with the electric brushes 10 of the motor 100. Each commutator segment 903 is provided with one conductive terminal 904. The conductive terminals 904 are used for being electrically connected with the windings 8. An insulating groove 907 is arranged between every two adjacent commutator segments 903 for electrical isolation.

Figure 3:
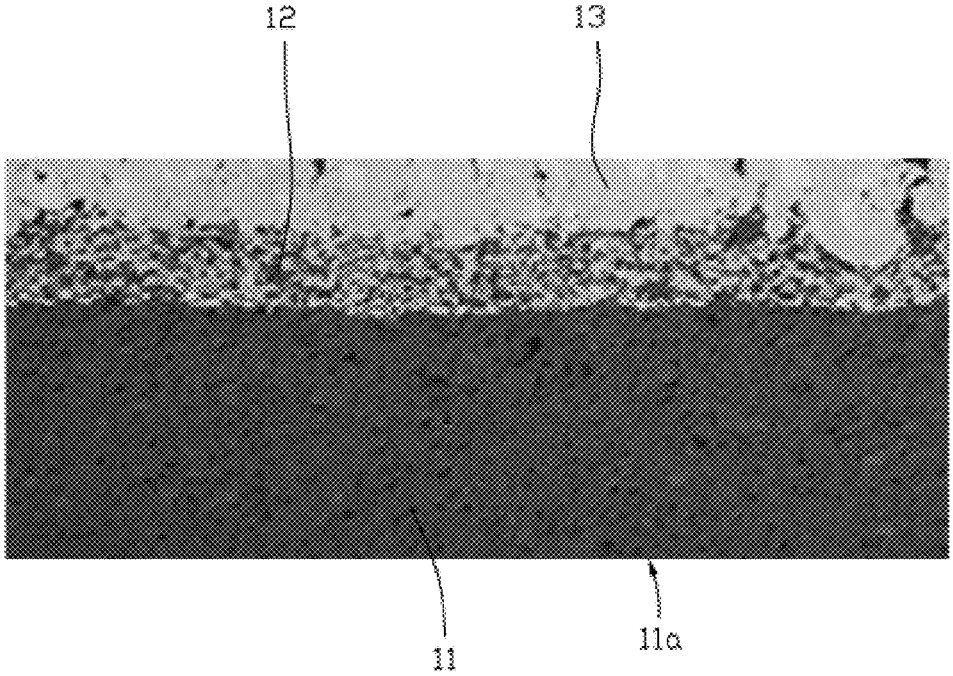
FIG. 3 is a schematic diagram of a cross section of the commutator of FIG. 1, showing a graphite layer, a transition layer and a metal layer of a commutator segment.

Referring to FIG. 3, the commutator segment 903 is in a three-layer structure, comprising a graphite layer 11, a transition layer 12 and a metal layer 13. The transition layer 12 is connected between the graphite layer 11 and the metal layer 13. The transition layer 12 contains a material identical to that of the graphite layer 11 and a material identical to that of the metal layer 13. The graphite layer 11 comprises a contact surface 11*a* away from the transition layer 12 for being in sliding contact with the electric brushes 10. The metal layer 13 is arranged on the insulating base 905 (shown in FIG. 2) for fixedly welding with a connecting end of the conductive terminal 904 that extends into the insulating base.

The material of the graphite layer 11 is graphite powder. The graphite powder is at least one selected from a group consisting of natural graphite, artificial graphite and meso-carbon microbeads.

The transition layer 12 is sandwiched between the graphite layer and the metal layer 13. The material of the transition layer 12 is graphite powder and metal powder. The transition layer 12 is used for reducing heat expansion of the commutator 9 during motor operation. In this embodiment, the graphite powder is at least one selected from a group consisting of natural graphite, artificial graphite, coke and meso-carbon microbeads. The metal powder is at least one selected from a group consisting of one or combination of copper powder and silver-plated copper powder.

Figure 4A:
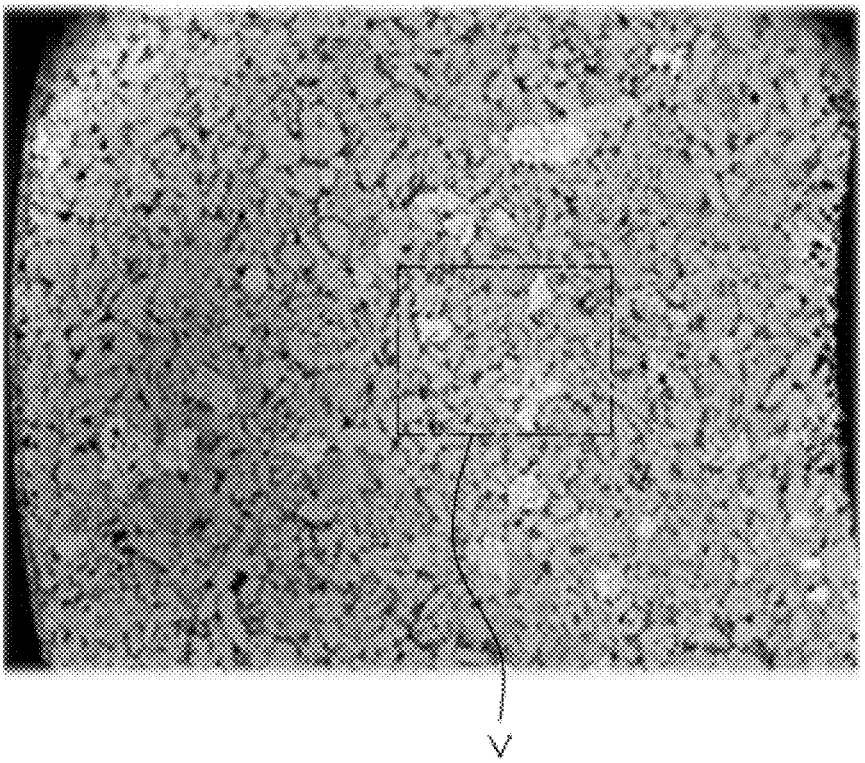
FIG. 4*a* is a scanning electron microscope of a mixture formed by metal powder and graphite powder in the transition layer of the commutator of FIG. 2.
Figure 4B:
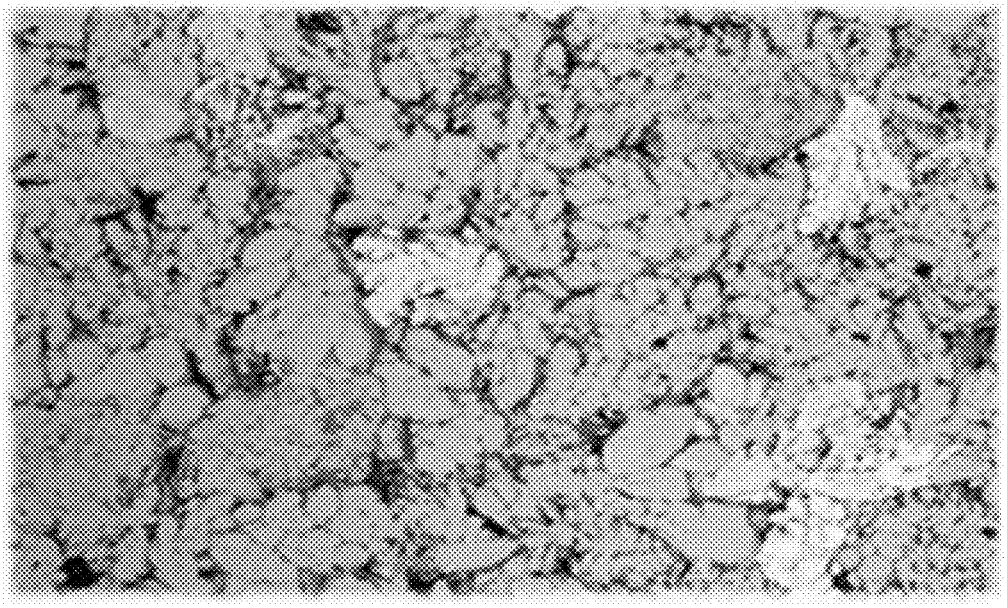
FIG. 4*b* is an enlarged drawing of the V portion in FIG. 4*a;*

FIG. 4*a* and FIG. 4*b* illustrates solid surface of the transition layer 12 observed through a scanning electron microscopy. It can be seen that the graphite powder and metal powder used in the transition layer 12 are in various morphologies such as flaky, branch-like, spherical or irregular shapes.

The material of the metal layer 13 is metal powder, preferably the metal is difficult to react with graphite to form carbide. For example, the metal can be at least one selected from a group consisting of Al, Cu, Ag, Ni, Bi, Sb.

Figure 5:
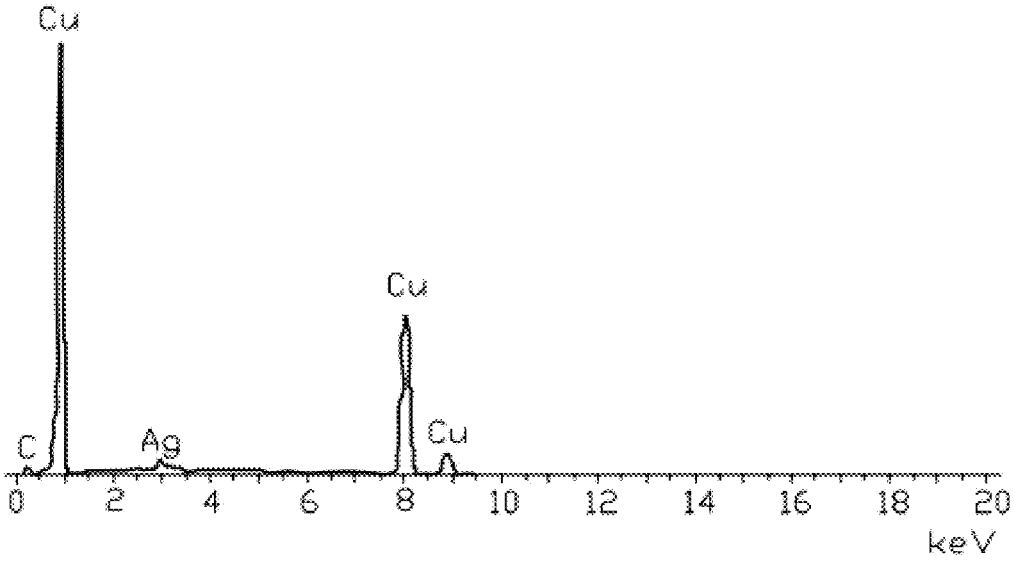
FIG. 5 illustrates atomic absorption peak of main elements in the metal layer measured by an atomic absorption photometer.

Referring to FIG. 5, the metal powder of the metal layer 13 in this embodiment is mixture power containing copper powder and silver-plated copper powder. As seen in the atomic absorption peak drawing, there are four atomic absorption peaks in total, wherein three of the four atomic absorption peaks are copper-element absorption peaks, and the other one of the four atomic absorption peaks is a silver-element absorption peak. The metal powder used in the implementation manner has low hardness and strong resistance to oxidation.

The mass ratio of the graphite powder in the transition layer 12 is 10% to 30%. The mass ratio of the metal powder in the metal layer 13 is 70% to 90%. The mass ratio is calculated according raw material.

The material of the transition layer 12 comprises graphite powder, so that the transition layer 12 has self-lubrication as graphite characteristic. The material of the transition layer 12 also comprises metal powder, so that the layer has excellent thermal conductance and excellent thermal conductivity.

The graphite layer 11, the transition layer 12 and the metal layer 13 all have a certain thickness. The thickness of the transition layer 12 is preferred within 100-500 μm. The thickness of the metal layer 13 is preferred within 100-500 μm. The thickness of the graphite layer is preferred within 1600-2400 μm. The metal material used in the transition layer 12 is not limited within Cu and Ag. For example, the metal material can be at least one selected from a group consisting of Al, Ni, Bi, Sb and other metals.

In the present invention, "the thickness of the graphite layer 11", "the thickness of the metal layer 13" and "the thickness of the transition layer 12" refer to a thickness observed and measured through an optical microscope.

Figure 6:
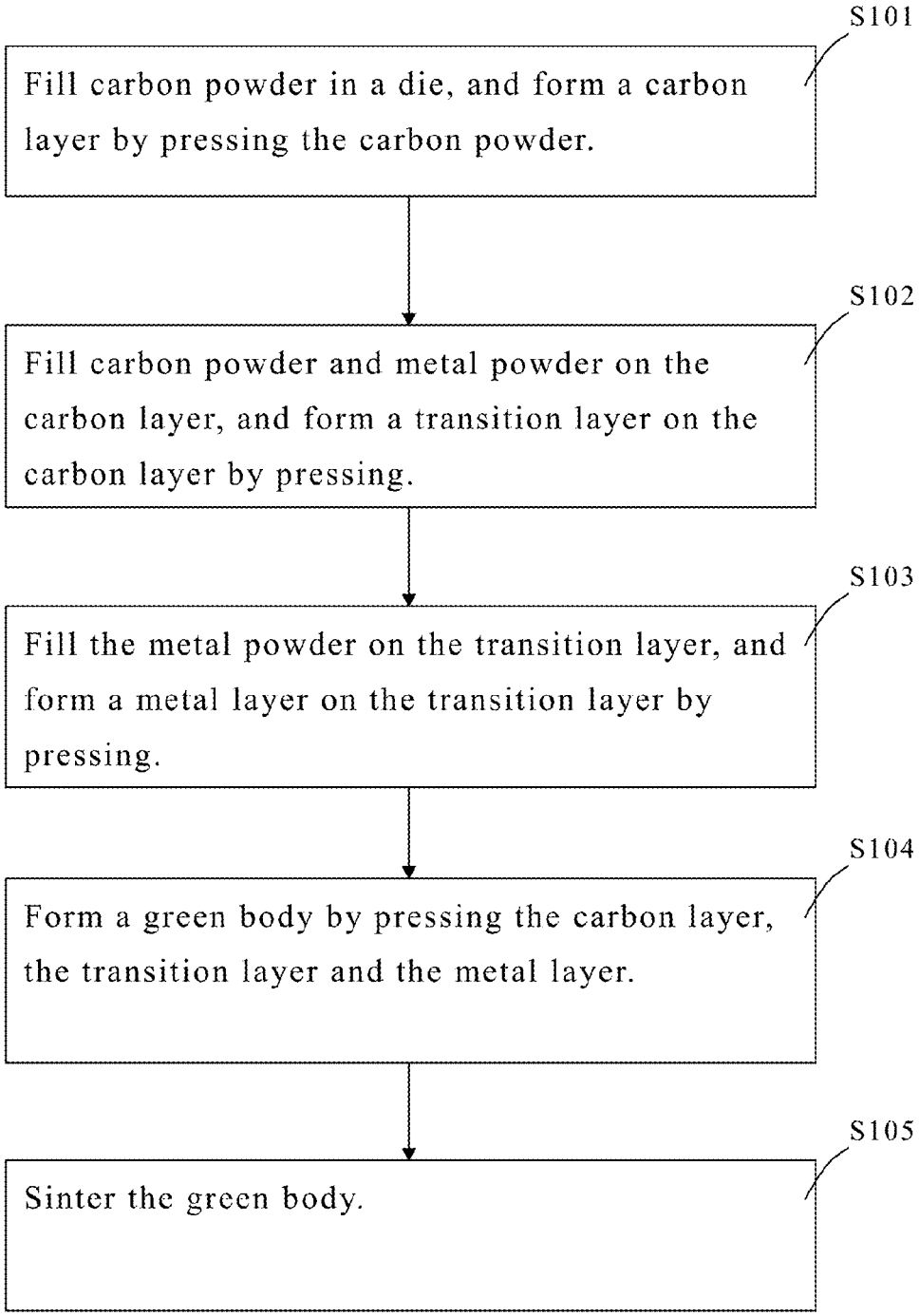
FIG. 6 is a flow chart of a method of manufacturing a commutator according to an embodiment of the present invention.

Referring to FIG. 6, the method of manufacturing the commutator comprises the following processes.

In step S101, graphite powder is filled in a die, and then a graphite layer 11 is formed by pressing the graphite powder. The graphite powder is at least one selected from a group consisting of natural graphite, artificial graphite and meso-carbon microbeads.

In step S102, graphite powder and metal powder are filled on the graphite layer 11, and then a transition layer 12 is formed on the graphite layer 11 by pressing. In this step, the graphite powder is at least one selected from a group consisting of natural graphite, artificial graphite, coke and meso-carbon microbeads. The metal powder is at least one selected from a group consisting of copper powder and silver-plated copper powder. Preferably, the graphite powder used to form the transition layer 12 is identical to the graphite powder used to form the graphite layer In step S103, the metal powder is filled on the transition layer 12, and then a metal layer 13 is formed on the transition layer by pressing. The metal powder is at least one selected from a group consisting of copper powder and silver-plated copper powder. Preferably, the metal powder used to form the metal layer 13 is identical to the metal powder used to form the transition layer 12.

In step S104, a green body is formed by pressing the graphite layer 11, the transition layer 12 and the metal layer 13. In the embodiment, and the green body can be pressed by a Cold-Isostatic Pressing (CIP molding) molding machine.

In step S105, the green body is sintered. Curing and sintering temperature, time and atmosphere of the green body are properly set according to the material, shape and size of the metal powder and graphite powder. For example, the curing and sintering temperature of the green body can be set as a softening-melting temperature of the metal powder forming the metal layer 13. In this embodiment, the curing temperature of the green body is preferably set as 200-450° C., and the sintering temperature of the green body is preferably set as 550-850° C.

When green body is sintered, the sintered mature body is connected with the conductive terminal 904 (FIG. 2) and assembled on the insulating base. The sintered mature body is then slotted to form commutator segments 903 (FIG. 2) arranged mutually spaced by corresponding slots 907 (FIG. 2). The conductive terminal 904 (FIG. 2) can be connected to the sintered mature body by welding. The heating temperature and a heating pressure during welding are appropriately set according to the type, size and combining area of the graphite powder and metal powder.

In alternative embodiments, the steps of manufacturing the commutator can be regulated. For example, firstly filling the metal powder in a die to form the metal layer 13 by pressing; and then filling a mixture of the metal powder and the graphite powder on the metal layer 13 to form the transition layer 12 on the metal layer 13 by pressing; and filling the graphite powder on the transition layer 12 to form the graphite layer 11 on the transition layer 12 by pressing.

It's contemplated that the sintered mature body is manufactured by the steps: forming a metal layer, a graphite layer and a transition layer which is sandwiched between the metal layer and the graphite layer; forming a green body by pressing the graphite layer, the transition layer and the metal layer; and sintering the green body.

It's contemplated that the graphite layer could be formed in advance and then the transition layer is formed on the graphite layer, and the metal layer is formed on the transition layer.

It's contemplated that the metal layer is formed in advance and then the transition layer is formed on the metal layer, and the graphite layer is formed on the transition layer.

The manufacturing method for the commutator further can be optimized by regulating the proportion between the metal powder and the graphite powder in the transition layer 12, so that the performance of the commutator can be improved to a certain extent.

Compared with the prior art, as the transition layer contains the material identical to that of the graphite layer and the metal layer, the commutator provided by the invention solves a problem that the graphite layer and the metal layer are cracked during high temperature sintering. The service life of the commutator is prolonged. The method of manufacturing the commutator provided by the present invention reduces the chemical contamination and the production cost caused by the electroplating and brazing used in the traditional technology. The binding force between the graphite and a metal surface is improved by die pressing and sintering technology. The curing and sintering temperature used by the manufacturing method is lower, which can meet the operation in an environment at a higher application temperature. The commutator provided by the embodiment of the present invention is particularly suitable for the motor of such fluid transportation devices as an oil pump and the like.

Although the invention is described with reference to one or more preferred embodiments, it should be appreciated by those skilled in the art that various modifications are possible. Therefore, the scope of the invention is to be determined by reference to the claims that follow.

In the description and claims of the present application, each of the verbs "comprise", "include", "contain" and "have", and variations thereof, are used in an inclusive sense, to specify the presence of the stated item but not to exclude the presence of additional items.

What is claimed is:

1. A commutator, comprising an insulating base and a plurality of commutator segments arranged on the insulating base, wherein each of the commutator segment comprises a metal layer, a transition layer and a graphite layer all arranged in sequence, the transition layer containing a material identical to that of the graphite layer and a material identical to that of the metal layer.

2. The commutator of claim 1, wherein the commutator further comprises a plurality of conductive terminals, each of the conductive terminals being connected to the metal layer of corresponding one of the commutator segments.

3. The commutator of claim 1, wherein the material of the graphite layer is graphite powder, which is at least one selected from a group consisting of natural graphite, artificial graphite and meso-carbon microbeads.

4. The commutator of claim 1, wherein the material of the transition layer is a mixture of graphite powder and metal powder.

5. The commutator of claim 4, wherein the mass ratio of the graphite powder in the transition layer is 10% to 30%, and the mass ratio of the metal powder is 70% to 90%.

6. The commutator of claim 4, wherein the graphite powder is at least one selected from a group consisting of natural graphite, artificial graphite, coke and meso-carbon microbeads, and the metal powder is at least one selected from a group consisting of Al, Cu, Ag, Ni, Bi, Sb or an alloy at least containing one of the metals.

7. The commutator of claim 1, wherein the material of the metal layer is metal powder, and the metal powder is at least one selected from a group consisting of Al, Cu, Ag, Ni, Bi, Sb.

8. The commutator of claim 1, wherein the transition layer thickness is 100-500 μm, the metal layer thickness is 100-500 μm, and the graphite layer thickness is 1600-2400 μm.

9. A motor, comprising a housing, and a rotor and an electric brush installed in the housing, further comprising the commutator for being in sliding contact with the electric brush, wherein the commutator comprises:

an insulating base, and;

a plurality of commutator segments arranged on the insulating base, each of the commutator segment comprising a metal layer, a transition layer and a graphite layer all arranged in sequence, the transition layer containing a material identical to that of the graphite layer and a material identical to that of the metal layer.

10. A method of manufacturing a commutator, comprising the following steps of:

forming a metal layer, a graphite layer and a transition layer which is sandwiched between the metal layer and the graphite layer in a die, wherein the transition layer containing a material identical to that of the graphite layer and a material identical to that of the metal layer;

forming a green body by pressing the graphite layer, the transition layer and the metal layer; and forming a sintered mature body by sintering the green body.

11. The method of claim 10, wherein:

the graphite layer is formed by: filling graphite powder in a die, and pressing the graphite powder;

the transition layer is formed on the graphite layer by: filling graphite powder and metal powder in the die on the graphite layer, and pressing the graphite powder and the metal powder;

the metal layer is formed on the transition layer by: filing metal powder in the die on the transition layer, and pressing the metal powder.

12. The method of claim 10, wherein:

the metal layer is formed by: filling metal powder in a die, and pressing the metal powder;

the transition layer is formed on the metal layer by: filling graphite powder and metal powder in the die on the metal layer, and pressing the graphite powder and the metal powder;

the graphite layer is formed on the transition layer by: filing graphite powder in the die on the transition layer, and pressing the graphite powder.

13. The method of claim 10, wherein the graphite powder of the graphite layer is at least one selected from a group consisting of natural graphite, artificial graphite and meso-carbon microbeads.

14. The method of claim 10, wherein the mass ratio of the graphite powder in the transition layer is 10% to 30%, and the mass ratio of the metal powder is 70% to 90%.

15. The method of claim 10, wherein the graphite powder is at least one selected from a group consisting of natural graphite, artificial graphite, coke and meso-carbon microbeads, and the metal powder is at least one selected from a group consisting of Al, Cu, Ag, Ni, Bi, Sb or an alloy at least containing one of the metals.

16. The method of claim 10, wherein a thickness range of the transition layer is 100-500 μm, a thickness range of the metal layer is 100-500 μm, and a thickness range of the graphite layer is 1600-2400 μm.

17. The method of claim 10, wherein the method further comprising:

forming a plurality of commutator segments by slotting the sintered mature body, two adjacent ones of the commutator segments being spaced by an insulating slot.

18. The method of claim 10, wherein the method further comprising:

connecting the sintered mature body with a conductive member and assembled on an insulating base; forming a plurality of commutator segments and conductive terminal by slotting the sintered mature body and the conductive member.

* * * * *